US009616495B2

(12) United States Patent
Gong et al.

(10) Patent No.: US 9,616,495 B2
(45) Date of Patent: Apr. 11, 2017

(54) AMORPHOUS ALLOY AND METHOD FOR MANUFACTURING THE SAME

(71) Applicants: Shenzhen BYD Auto R&D Company Limited, Shenzhen, Guangdong (CN); BYD Company Limited, Pingshan, Shenzhen, Guangdong (CN)

(72) Inventors: Qing Gong, Guangdong (CN); Faliang Zhang, Guangdong (CN); Yunchun Li, Guangdong (CN)

(73) Assignee: SHENZHEN BYD AUTO R&D COMPANY LIMITED, Shenzhen (CN)

( * ) Notice: Subject to any disclaimer, the term of this patent is extended or adjusted under 35 U.S.C. 154(b) by 341 days.

(21) Appl. No.: 14/365,856

(22) PCT Filed: Dec. 14, 2012

(86) PCT No.: PCT/CN2012/086651

§ 371 (c)(1),
(2) Date: Jun. 16, 2014

(87) PCT Pub. No.: WO2013/087022

PCT Pub. Date: Jun. 20, 2013

(65) Prior Publication Data

US 2014/0305549 A1 Oct. 16, 2014

(30) Foreign Application Priority Data

Dec. 15, 2011 (CN) ..... 2011 1 0421224

(51) Int. Cl.

| | |
|---|---|
| ***C22C 1/00*** | (2006.01) |
| ***B22D 25/06*** | (2006.01) |
| ***C22C 45/10*** | (2006.01) |

(52) U.S. Cl.

CPC ..... *B22D 25/06* (2013.01); *C22C 1/002* (2013.01); *C22C 45/10* (2013.01)

(58) Field of Classification Search

None

See application file for complete search history.

(56) References Cited

U.S. PATENT DOCUMENTS

| | | | | |
|---|---|---|---|---|
| 5,954,501 | A | 9/1999 | Masumoto et al. | |
| 6,021,840 | A | 2/2000 | Colvin | |
| 6,521,058 | B1 | 2/2003 | Inoue et al. | |
| 6,682,611 | B2 * | 1/2004 | Zhang | C22C 45/10 148/403 |
| 2003/0079813 | A1 | 5/2003 | Zhang et al. | |
| 2011/0097237 | A1 | 4/2011 | Gong et al. | |
| 2012/0067466 | A1 * | 3/2012 | Gong | C22C 45/10 148/538 |

FOREIGN PATENT DOCUMENTS

| | | | |
|---|---|---|---|
| CN | 201023131 | Y | 2/2008 |
| CN | 101293277 | A | 10/2008 |
| CN | 201308981 | Y | 9/2009 |
| CN | 101596585 | A | 12/2009 |
| CN | 102080165 | A | 6/2011 |
| CN | 102527982 | A | 7/2012 |
| CN | 102534437 | A | 7/2012 |
| JP | 11-100648 | A | 4/1999 |
| JP | 11100648 | | 4/1999 |
| JP | 2004-155050 | A | 6/2004 |
| JP | 2010-144245 | A | 7/2010 |
| JP | 2010144245 | | 7/2010 |

OTHER PUBLICATIONS

ASM Handbook vol. 2: Properties and Selection: Nonferrous Alloys and Special-Purpose Metals, "Preparation and Characterization of Pure Metals", pp. 1093-1097, ASM, 1990.*

Huang, Jinsong, et al., "*Research Progress and Application of Zr-Based Amorphous Alloys*," The Chinese Journal of Nonferrous Metals, vol. 13, No. 6, Dec. 2003, pp. 1321-1332.

International Search Report and Written Opinion to PCT/CN2012/086651 dated Mar. 28, 2013 (11p).

* cited by examiner

*Primary Examiner* — George Wyszomierski

(74) *Attorney, Agent, or Firm* — Brinks Gilson & Lione

(57) ABSTRACT

An amorphous and a manufacturing method thereof are provided. The amorphous alloy may have a formula of $Zr_aCu_bAl_cM_dN_e$, M is at least one selected from the group consisting of Ni, Fe, Co, Mn, Cr, Ti, Hf, Ta, Nb and rare earth elements; N is at least one selected from a group consisting of Ca, Mg, and C; $40 \le a \le 70$, $15 \le b \le 35$, $5 \le c \le 15$, $5 \le d \le 15$, $0 \le e \le 2$, and $a+b+c+d+e=100$.

6 Claims, No Drawings

AMORPHOUS ALLOY AND METHOD FOR MANUFACTURING THE SAME

CROSS-REFERENCE TO RELATED APPLICATION

This application is the national phase application of PCT Application No. PCT/CN2012/086651, filed Dec. 14, 2012, which claims priority to and benefits of Chinese Patent Application Serial No. 201110421224.6, filed with the State Intellectual Performance Office (SIPO) of P. R. China on Dec. 15, 2011, the entire contents of which are incorporated herein by reference.

FIELD

The present disclosure relates to the field of material science, more particularly to an amorphous alloy and a method for manufacturing the same.

BACKGROUND

The statements in this section merely provide background information related to the present disclosure and may not constitute prior art.

Amorphous alloy was developed in 1960s, as the critical size of the initial amorphous alloy can only reach a micron level, it is difficult to be practically utilized; however, material properties of high strength, high hardness, corrosion resistance and excellent high temperature fluidity and so on have attracted massive scientists' interests.

However, amorphous alloy and method for manufacturing the same also needs to be improved.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

In viewing thereof, the present disclosure is directed to solve at least one of the problems existing in the art. Accordingly, an amorphous alloy may need to be provided, critical size and mechanical properties of which may be improved.

According to an aspect of the present disclosure, an amorphous alloy may be provided, which may have a formula of $Zr_aCu_bAl_cM_dN_e$. In the formula, M may be at least one selected from the group consisting of Ni, Fe, Co, Mn, Cr, Ti, Hf, Ta, Nb and rare earth elements; N may be at least one selected from the group consisting of Ca, Mg, and C; $40 \le a \le 70$, $15 \le b \le 35$, $5 \le c \le 15$, $5 \le d \le 15$, $0 \le e \le 2$, and $a+b+c+d+e=100$.

According to the amorphous alloy of an embodiment of the present disclosure, with the addition of Ca, Mg and C, the amount of precious metal may be effectively reduced or even eliminated. And with the addition of Ca, Mg and C, the content of non-metallic elements such as O, N and so on may be effectively suppressed in the amorphous alloy, and the critical size and mechanical properties of the amorphous alloy may be improved, making the amorphous alloy more suitable for industrial production and/or utilization. In addition, with the addition of Ca, Mg and C, the requirements for purity of the amorphous alloy raw material may be reduced, which may contribute to reduce the production cost.

According to a second aspect of the present disclosure, a method of manufacturing an amorphous alloy may be provided, which comprises providing an amorphous base alloy and an additive material; melting the amorphous base alloy and the additive material under a vacuum atmosphere or an inert atmosphere to form a mixed melt; and casting the mixed melt and cooling to form the amorphous alloy.

According to embodiments of the present disclosure, with the addition of the additive material, the amount of precious metal may be effectively reduced or even eliminated, the content of non-metallic elements such as O, N and so on may be effectively suppressed in the amorphous alloy, and the critical size and mechanical properties of the amorphous alloy may be improved, making the amorphous alloy more suitable for industrial production and/or utilization. In addition, with the addition of the additive material, the requirements for purity of the amorphous alloy raw material may be reduced, which may contribute to reduce the production cost.

Additional aspects and advantages of embodiments of present disclosure will be given in part in the following descriptions, become apparent in part from the following descriptions, or be learned from the practice of the embodiments of the present disclosure.

DETAILED DESCRIPTION

Embodiments of the present disclosure will be described in detail in the following descriptions. It is to be understood that, the embodiments described herein are merely used to generally understand the present disclosure, but shall not be construed to limit the present disclosure.

Amorphous Alloy

The amorphous alloy according to embodiments of the present disclosure will be described firstly.

According to embodiments of the present disclosure, an amorphous alloy having a formula of $Zr_aCu_bAl_cM_dN_e$ may be provided.

In the formula $Zr_aCu_bAl_cM_dN_e$, M may be at least one selected from a group consisting of Ni, Fe, Co, Mn, Cr, Ti, Hf, Ta, Nb and rare earth element.

In the formula $Zr_aCu_bAl_cM_dN_e$, N may be at least one selected from a group consisting of Ca, Mg, and C.

In the formula $Zr_aCu_bAl_cM_dN_e$, a, b, c, d, and e may represent the atomic percentage of the respective element, and $40 \le a \le 70$, $15 \le b \le 35$, $5 \le c \le 15$, $5 \le d \le 15$, $0 \le e \le 2$, with a proviso that $a+b+c+d+e=100$.

According to the amorphous alloy of an embodiment of the present disclosure, with the addition of Ca, Mg and C, the amount of precious metal may be effectively reduced or even eliminated. And with the addition of Ca, Mg and C, the content of non-metallic elements such as O, N and so on may be effectively suppressed in the amorphous alloy, and the critical size and mechanical properties of the amorphous alloy may be improved, making the amorphous alloy more suitable for industrial production and/or utilization. In addition, with the addition of Ca, Mg and C, the requirements for purity of the amorphous alloy raw material may be reduced, which may contribute to reduce the production cost.

In one embodiment of the present disclosure, the amorphous alloy may comprise an impurity element, and the atomic percentage of the impurity element in the amorphous alloy may be about 2% or less. In addition, in one embodiment of the present disclosure, the amorphous alloy may have an amorphous phase content of about 50% by volume or more. Further, in one embodiment of the present disclosure, the amorphous alloy may have a critical size of larger than about 1 mm. Advantageously, the amorphous alloy may comprise elements O and N and the concentration of O and N may be about 1000 ppm or less respectively. In other words, the amorphous alloy may comprise element O in an amount of 1000 ppm or less, and the amorphous alloy may comprise element N in an amount of 1000 ppm or less.

Manufacturing Method of Amorphous Alloy

In the following description, a method of manufacturing an amorphous alloy according to embodiments of the present disclosure will be described.

According to embodiments of the present disclosure, the method of manufacturing an amorphous alloy may comprise the following steps:

Firstly, an amorphous base alloy and an additive material may be provided.

Then, the amorphous base alloy and the additive material may be melted under a vacuum atmosphere or an inert atmosphere to form a mixed melt.

Finally, the mixed melt may be casted and cooled to form the amorphous alloy.

According to embodiments of the present disclosure, with the addition of the additive material, the amount of precious metal may be effectively reduced or even eliminated, the content of non-metallic elements such as O, N and so on may be effectively suppressed in the amorphous alloy, and the critical size and mechanical properties of the amorphous alloy may be improved, making the amorphous alloy more suitable for industrially production and/or utilization. In addition, with the addition of the additive material, the requirements for purity of the amorphous alloy raw material may be reduced, which may contribute to reduce the production cost.

It should be noted that the method to form the mixed melt is not particularly limited. In one embodiment of the present disclosure, during the process of melting the amorphous alloy of the present disclosure, melting the amorphous base alloy and the additive material may further comprise: mixing the amorphous base alloy and the additive material to form a mixture; and then melting the mixture to form the mixed melt. And in another embodiment of the present disclosure, melting the amorphous base alloy and the additive material further comprises: melting the amorphous base alloy to form a first melt; and then adding the additive material to the first melt to form the mixed melt.

In some embodiments of the present disclosure, the amorphous base alloy may have a formula of Zr—Cu—Al-M. And in one embodiment of the present disclosure, M may be at least one selected from the group consisting of Ni, Fe, Co, Mn, Cr, Ti, Hf, Ta, Nb and rare earth elements. And in one embodiment of the present disclosure, the additive material may comprise at least one selected from the group consisting of Ca, Mg and C.

In some embodiments of the present disclosure, in the alloy system of Zr—Cu—Al-M, M may be at least one selected from the group consisting of Ni, Fe, Co, Mn, Cr, Ti, Hf, Ta, Nb and rare earth elements or a combination thereof, whereas the elements O, N and the like will easily react with Zr in the amorphous alloy to form oxide and nitride, which may be dissolved in the amorphous alloy melt, or may be distributed in a surface of the amorphous alloy melt as heterogeneous nucleation points, thereby the critical size of the amorphous alloy may be significantly reduced which even results in being unable to form the amorphous alloy. Accordingly, at a basis of Zr—Cu—Al-M alloy system, adding at least one selected from the group consisting of inexpensive Ca, Mg and C, the content of elements O and N in the alloy may be effectively controlled, facilitating the formation of the amorphous alloy.

It should be noted that the additive material may be added in a form of simple substance, or in a form of alloy. For example, element Ca may be introduced in a form of calcium-aluminum alloy, element Mg may be introduced in a form of magnesium-aluminum alloy, element C may be introduced in a form of iron-carbon alloy. Considering both Ca and Mg have a lower boiling point, the alloy is preferred to be used for introducing the element(s) to effectively prevent a burning loss caused by the volatilization of the added element(s).

In addition, due to the metallic property of the additive material element is better than that of the base alloy, therefore, in the step of melting, the additive material element may preferentially have a chemical reaction with O and N in the alloy melt, forming oxide and nitride. The resulting oxide and nitride will float on a surface of the melt forming a slag system and may be excluded out of the first melt because of lower density, thus a purifying effect of removing impurity element in the alloy may be achieved, and then the objective of improving the critical size of the amorphous alloy while reducing the requirement to the purity of raw material may be achieved.

Herein, it should be noted that due to the reaction consumption and the volatilization of the additive material element, a melting temperature below the boiling point of the additive material element is preferred, for the purpose of avoiding the volatilization of the additive material element. For example, the boiling point of Ca is 1484 degree Celsius, then the melting temperature preferably is below 1484 degree Celsius when introducing Ca element in the course of melting step, and the boiling point of Mg is 1090 degree Celsius, then the melting temperature preferably is below 1090 degree Celsius when introducing Mg element in the course of melting step, and the rest may be deduced by analogy.

Due to the effect of the additive material, the requirement for the purity of the raw material may be significantly decreased. For example, in the case that the amorphous alloy is Zr-based amorphous alloy, the purity of the Zr may be reduced to 99 wt %, so an industrial grade Zr metal may meet the requirements of the amorphous alloy production, while the requirements for the purities of other elements may preferably be 99.9 wt % or above. Thus the requirements for the purity of raw material may be reduced, and the usual industrial grade raw material may be used which greatly reduces raw material cost of the amorphous alloy.

The amorphous alloy manufacturing by the method according to one embodiment of the present disclosure may have a formula of $Zr_aCu_bAl_cM_dN_e$. In one embodiment, N is at least one selected from a group consisting of Ca, Mg, and C; a, b, c, d and e are atomic percentage respectively, $40 \le a \le 70$, $15 \le b \le 35$, $5 \le c \le 15$, $5 \le d \le 15$, $0 \le e \le 2$, and $a+b+c+d+e=100$.

The present inventor has surprisingly found out that, by properly adding a reducing element, such as Ca, Mg and C and so on, the formation of oxide and nitride Zr may be effectively suppressed, and the formed oxides of Ca and Mg may easily form a slag with low melting point which may be eliminated in the melting process, and the formed oxide of C may be excluded in a form of gas. To facilitate the control of production and sufficiently remove O and N in the alloy, the total amount of elements Ca, Mg and C and so on in the alloy should be controlled in the range of 0%-2% in term of atomic percentage. Less amount of the additive elements Ca, Mg and C and so on may lead to insufficient removing of O and N, excessive amount of the additive elements Ca, Mg and C and so on may result in decreased critical size of the resulting amorphous alloy or even hardly obtaining the amorphous alloy, therefore, the total amount of elements Ca, Mg and C and so on may preferably is less than 1%, further preferably less than 0.5%.

In addition, the introduction of additive material also reduces the restrictions to the amorphous alloy melting conditions, and the commonly-used ultra-high vacuum condition for preparing the amorphous alloy and high-purity inert gas condition may be significantly reduced, for example the vacuum degree may be decreased to 1000 Pa or less. The purity requirement of the inert gas concentration may be reduced to 99.9% in term of volume percentage or even 99% in term of volume percentage, while guaranting the obtaining of the amorphous alloy.

The amorphous alloy having the above formula prepared according to embodiments of the present disclosure, the concentration of O and N may be about 1000 ppm or less respectively, preferably is about 600 ppm or less respectively.

The present inventor has found out that the additive elements Ca, Mg and C and so on may also has an function of cleaning alloy solution, so in addition to elements O and N, the amorphous alloy according to embodiment of the present disclosure may also contain an impurity element in an amount of 2% or less, which will not significantly affect the formation of the amorphous alloy.

Completely amorphous alloy may provide a desired mechanical strength, but depending on specific application of the amorphous alloy material, a certain amount of crystalline phase may be allowed, although it will sacrifice the material strength, the amount of the precious metals may be reduced and the size of the amorphous alloy parts may be increased. In one embodiment of the present disclosure, the amorphous phase content preferably may constitute about 50% or more of the amorphous alloy.

Further advantageously, in one embodiment of the present disclosure, the critical size of the resulting amorphous alloy may be greater than 1 mm.

The amorphous alloy and the method for manufacturing an amorphous alloy will be further described below in way of example. Raw materials used in Examples and Comparative Examples are all commercially available.

Metals Zr, Al, Cu, Ni, Hf were weighted out according to the formula of $Zr_{52}Al_{10}Cu_{30}Ni_7Hf$, which was listed in Table 1. And the metals weighted out were added to a vacuum melting furnace charged with 99.99% argon as protection atmosphere, and the metals were subjected to melting to form an amorphous base alloy melt.

After the formation of an even amorphous base alloy melt, the amorphous base alloy melt was continued melting after adding proper amount of additive materials which was listed in Table 1. Here, when adding the additive materials, 20 wt % burning loss should be counted, element Ca was added in the form of calcium-aluminum alloy, element Mg was added in the form of magnesium alloy, element C is added in the form of iron-carbon alloy and carbon rod, raw materials was subjected to comparison test by using two different purities, the purities of the raw materials were industrial-purity materials with a purity of above 99% and high-purity materials with a purity of above 99.9%, respectively.

Next, confirmed the completion of the additive material reaction by visual study, the alloy melt was injected into a metal mold and casted. A casted article having a size of 4 mm×10 mm×80 mm was obtained, and the casted article was then subjected to tests of mechanical strength and oxygen content. In addition, the melt was injected into a copper mold and casted to obtain cast ingots having different cross-sectional areas, the ingots were then subjected to determination of the critical size.

To compare the beneficial effects of the amorphous alloy according to embodiments of the present disclosure, $Zr_{52}Al_{10}Cu_{30}Ni_7Hf$ without additive material was prepared and tested in parallel as Comparative Examples. The results of examples and Comparative Examples were listed in Table 1.

The test method and conditions used in the examples and Comparative Examples are described as follows:

The highest melting temperature during melting process was obtained by using infrared temperature tests.

The critical size was measured by a test on D/Max2500PC XRD diffraction instrument from Rigaku Corporation, diffraction angle of 2 theta was between 20°~60°, scanning speed was 4°/min, scanning voltage was 40 Kv, current was 200 mA.

Test of element oxygen was obtained by using TC-306 nitrogen oxide analysis instrument produced from Optoelectronics Technology Co., Ltd., Shanghai Bao Ying, a Nickel Baskets was used as a fluxing agent, sample weight was 0.2 g to 0.4 g, high-purity Helium gas was used as shielding gas, gas parameter was 99.999%, and pressure was 0.2 MPa.

Here, it should be noted that, as mechanism of N-exclusion was same as mechanism of O-exclusion, so measurement of element N was omitted in the test, analysis of the amorphous alloy was performed just by measuring concentration of element O.

The test for mechanical strength of the amorphous alloy was accomplished on CMT-5105 computer-controlled electronic universal testing machine produced by MTS Company, three-point bending mode was used, test span was 62 mm, loading rate was 2 mm/min, and test temperature was room temperature.

| No. | Formula | Purity of raw material (weight percentage) | Highest melting temperature (° C.) | Critical size (mm) | Bending strength (MPa) | Content of O (ppm) | cost |
|---|---|---|---|---|---|---|---|
| Comparative Example 1 | $Zr_{52}Al_{10}Cu_{30}Ni_7Hf$ | >99.9% | 1200 | 7 | 2200 | 800 | high |
| Comparative Example 2 | $Zr_{52}Al_{10}Cu_{30}Ni_7Hf$ | >99% | 1200 | 0.8 | 1200 | 1500 | low |
| Example 1 | $Zr_{51.9}Al_{10}Cu_{30}Ni_7HfCa_{0.1}$ | >99% | 1200 | 8 | 2500 | 620 | low |
| Example 2 | $Zr_{51.5}Al_{10}Cu_{30}Ni_7HfCa_{0.5}$ | >99% | 1200 | 6 | 2300 | 450 | low |
| Example 3 | $Zr_{50}Al_{10}Cu_{30}Ni_7HfCa_2$ | >99% | 1200 | 4 | 1800 | 420 | low |
| Example 4 | $Zr_{51.8}Al_{10}Cu_{30}Ni_7HfCa_{0.1}Mg_{0.1}$ | >99% | 1050 | 9 | 2700 | 400 | low |
| Example 5 | $Zr_{51.95}Al_{10}Cu_{30}Ni_7HfC_{0.05}$ | >99% | 1200 | 10 | 2800 | 300 | low |
| Example 6 | $Zr_{51}Al_8Cu_{27}Ni_7Co_3Hf_{0.8}Fe_{2.5}Ti_{0.5}Cr_{0.1}C_{0.1}$ | >99% | 1200 | 6 | 2300 | 320 | low |
| Example 7 | $Zr_{51}Al_{10}Cu_{30.3}Ni_7HfFe_{0.5}Y_{0.05}Mg_{0.1}C_{0.05}$ | >99% | 1050 | 10 | 2800 | 300 | low |
| Example 8 | $Zr_{40}Al_{15}Cu_{30}Ni_{6.6}Ti_7Nb_{0.2}HfCa_{0.2}$ | >99% | 1300 | 2 | 1400 | 500 | low |

-continued

| No. | Formula | Purity of raw material (weight percentage) | Highest melting temperature (° C.) | Critical size (mm) | Bending strength (MPa) | Content of O (ppm) | cost |
|---|---|---|---|---|---|---|---|
| Example 9 | $Zr_{50}Al_{10}Cu_{30}Ni_{6.5}HfCa_{2.5}$ | >99% | 1200 | 0.5 | 800 | 400 | low |
| Example 10 | $Zr_{35}Al_{20}Cu_{30}Ni_{6.6}Ti_{7}HfCa_{0.4}$ | >99% | 1200 | 0.1 | 200 | 300 | low |
| Example 11 | $Zr_{51.8}Al_{10}Cu_{30}Ni_{7}HfMg_{0.2}$ | >99% | 1200 | 0.5 | 800 | 1100 | low |

It can be seen from Table 1 that, as shown by Comparative Examples 1 and 2, traditional formula $Zr_{52}Al_{10}Cu_{30}Ni_{7}Hf$ can only achieve an amorphous alloy with large size and high purity only by using a high-purity raw material (Comparative Example 1), the cost of raw materials was very high because the purities of the materials were required more than 99.9%. And the materials were susceptible to pollution of the impurity elements in the production process, thus the production process was difficult to be controlled.

Relative to traditional formula $Zr_{52}Al_{10}Cu_{30}Ni_{7}Hf$, as shown by examples 1, 2, 3, 4 and 5, with the addition of additive material elements Ca, Mg and C according embodiments of the present disclosure, the material property with high-purity and amorphous alloy critical size similar to the Comparative Examples 1 may be obtained even when using raw materials of industrial grade purity. It can be seen from Table 1 that, the additive elements may effectively reduce and control the oxygen content in the alloy, and the oxygen content of the alloy may be further decreased with increasing the amount of the additive material.

However, as shown by example 9, when the content of the additive element was higher than 2%, the critical size and mechanical properties of the amorphous alloys may be reduced, so even the oxygen content in the alloy was well controlled, the desired amorphous alloy will be hardly obtained.

In addition, as shown by example 11, due to the low boiling point of the additive elements, especially the boiling point of the element Ca and Mg was only 1484 degree Celsius and 1090 degree Celsius respectively, so once the alloy melting temperature exceeded the above temperatures in the melting process, it may cause massive volatilization of the additive element, and lost the effect of slagging and purification of the additive element.

Further, as shown by examples 6, 7 and 8, due to the effect of additive element, the existence of various metallic elements in the alloy may be allowed, and the content of various alloy elements in the amorphous alloy may be greatly increased while obtaining amorphous alloy with desired critical size and mechanical properties.

In addition, as shown by example 10, too much changes of the alloy element content may also lead to failure to obtain desired amorphous alloy.

Reference throughout this specification to "an embodiment," "some embodiments," "one embodiment", "another example," "an example," "a specific examples," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example, "in an example," "in a specific examples," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments can not be construed to limit the present disclosure, and changes, alternatives, and modifications can be made in the embodiments without departing from spirit, principles and scope of the present disclosure.

What is claimed is:

1. A method of manufacturing an amorphous alloy, comprising:

providing an amorphous base alloy; wherein the amorphous base alloy has a formula of Zr—Cu—Al-M, wherein M is at least one selected from the group consisting of Ni, Fe, Co, Mn, Cr, Ti, Hf, Ta, Nb and rare earth elements;

providing an additive material; wherein the additive material is at least one selected from the group consisting of calcium-aluminum alloy, magnesium alloy, iron-carbon alloy and carbon rod;

melting the amorphous base alloy and the additive material under a vacuum atmosphere or an inert atmosphere to form a mixed melt; and casting the mixed melt and cooling to form the amorphous alloy; wherein the amorphous alloy has a formula of $Zr_aCu_bAl_cM_dN_e$, and wherein M is at least one selected from the group consisting of Ni, Fe, Co, Mn, Cr, Ti, Hf, Ta, Nb and a rare earth element; N is at least one selected from the group consisting of Ca, Mg, and C; $40 \le a \le 70$, $15 \le b \le 35$, $5 \le c \le 15$, $5 \le d \le 15$, $0 < e \le 2$, and $a+b+c+d+e=100$.

2. The method according to claim 1, wherein melting the amorphous base alloy and the additive material further comprises:

mixing the amorphous base alloy and the additive material to form a mixture; and melting the mixture to form the mixed melt.

3. The method according to claim 1, wherein melting the amorphous base alloy and the additive material further comprises:

melting the amorphous base alloy to form a first melt; and adding the additive material to the first melt to form the mixed melt.

4. The method according to claim 1, wherein the step of melting is performed at the temperature of below the boiling point of the additive material.

5. The method according to claim 1, wherein the step of melting is performed under an atmosphere having vacuum degree of about 1000 Pa or less.

6. The method according to claim 1, wherein the melting is performed under an atmosphere with about 99% inert gas by volume or more.

* * * * *